US012516586B2

(12) United States Patent
Moreira Antunes et al.

(10) Patent No.: US 12,516,586 B2
(45) Date of Patent: Jan. 6, 2026

(54) CEMENT HEAD FLOW DIVERTER FOR TETHERED CEMENT PLUG DEPLOYMENT

(71) Applicant: Halliburton Energy Services, Inc., Houston, TX (US)

(72) Inventors: Tarcisio Moreira Antunes, Spring, TX (US); Lonnie Carl Helms, Bixby, OK (US); Michelle Kan, Houston, TX (US); Saul Emmanuel Vazquez Niebla, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 33 days.

(21) Appl. No.: 18/593,500

(22) Filed: Mar. 1, 2024

(65) Prior Publication Data

US 2025/0277425 A1 Sep. 4, 2025

(51) Int. Cl.
*E21B 33/16* (2006.01)
*E21B 47/005* (2012.01)

(52) U.S. Cl.
CPC ..... *E21B 33/16* (2013.01); *E21B 47/005* (2020.05)

(58) Field of Classification Search
CPC ..... E21B 33/16; E21B 33/165
See application file for complete search history.

(56) References Cited

U.S. PATENT DOCUMENTS 3,971,436 A * 7/1976 Lee ..... E21B 33/16 166/70
5,950,724 A * 9/1999 Giebeler ..... E21B 33/05 166/70
11,668,153 B2 6/2023 Vargo, Jr. et al.
2002/0157828 A1* 10/2002 King ..... E21B 47/01 166/250.14
2004/0060697 A1 4/2004 Tilton et al.
2008/0272931 A1* 11/2008 Auzerais ..... E21B 47/005 356/477
2011/0079401 A1* 4/2011 Gambier ..... E21B 23/08 166/117.6
2015/0000891 A1* 1/2015 Mowbray ..... E21B 33/165 166/64
2016/0102521 A1 4/2016 Robichaux et al.
2017/0096870 A1* 4/2017 Rogozinski ..... E21B 34/102
(Continued)

OTHER PUBLICATIONS

International Search Report & Written Opinion; PCT Application No. PCT/US2024/018373; mailed Nov. 26, 2024.

*Primary Examiner* — David Carroll
(74) *Attorney, Agent, or Firm* — NOVAK DRUCE CARROLL LLP

(57) ABSTRACT

Systems and methods are provided for tethered plug deployment using a cement head flow diverter. In some aspects, the present technology may include a cement head comprising: an elongated housing having a top opening, a bottom opening, and an interior housing space; a cap coupled to the top opening of the elongated housing, wherein the cap includes an aperture for receiving a communication line; an inner canister disposed within the interior housing space of the elongated housing, wherein the inner canister has a top open end, a bottom open end, and an interior canister space; and a cement plug disposed within the interior canister space of the inner canister, wherein a top portion of the cement plug is configured to couple to the communication line through the top open end of the inner canister.

17 Claims, 8 Drawing Sheets

(56) References Cited

U.S. PATENT DOCUMENTS

| | | | | |
|---|---|---|---|---|
| 2017/0370169 | A1* | 12/2017 | Genovese | E21B 33/165 |
| 2018/0313206 | A1* | 11/2018 | Dirksen | E21B 47/00 |
| 2020/0378209 | A1* | 12/2020 | Slup | E21B 33/13 |
| 2021/0238946 | A1* | 8/2021 | Vargo, Jr. | E21B 47/07 |

* cited by examiner

CEMENT HEAD FLOW DIVERTER FOR TETHERED CEMENT PLUG DEPLOYMENT

TECHNICAL FIELD

The present disclosure relates generally to systems and methods for implementing tethered cement plug deployment, and more specifically (although not necessarily exclusively), to systems and methods for implementing a cement head flow diverter.

BACKGROUND

Wellbores are formed by drilling deep into subterranean formations in order to withdraw hydrocarbons. Typically, the wellbore is lined with a steel casing string (or casing) after drilling in order to maintain the shape of the wellbore and to prevent loss of fluids to the surrounding environment. The steel casing is often bonded to the surface of the wellbore by a sealant such as cement. Cementing operations are carried out to inject cement into the annulus between the casing and the wellbore.

Customary cementing operations can include pumping cement through the bore of the casing, out the bottom of the casing, and up through the annulus between the surface of the wellbore and the external surface of the casing. In some cases, cement plugs may be deployed during the cementing operation. For example, a lower cement plug can be inserted into a casing string prior to commencing the cementing operation and an upper plug may be deployed at or near the end of the cementing operation.

DETAILED DESCRIPTION

Figure 1:
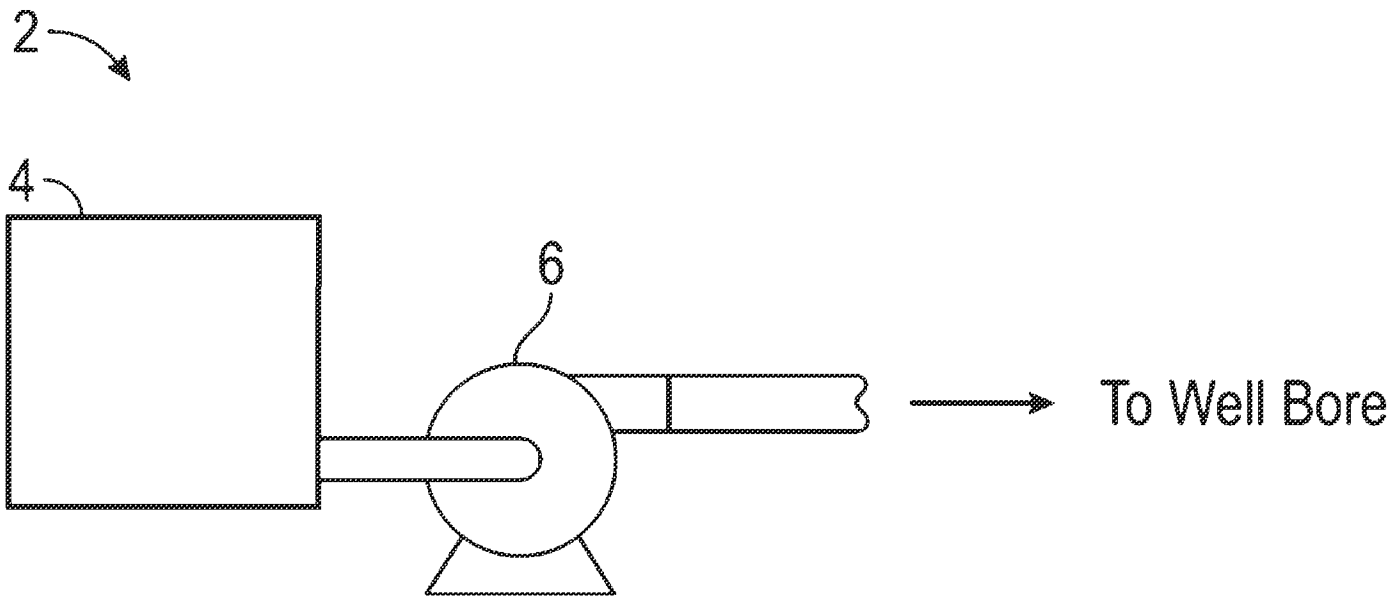
FIG. 1 illustrates a system for preparation and delivery of a cement composition to a wellbore, in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be apparent from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As used herein, "cement" is any kind of material capable of being pumped to flow to a desired location, and capable of setting into a solid mass at the desired location. "Cement slurry" designates the cement in its flowable state. In many cases, common calcium-silicate hydraulic cement is suitable, such as Portland cement. Calcium-silicate hydraulic cement includes a source of calcium oxide such as burnt limestone, a source of silicon dioxide such as burnt clay, and various amounts of additives such as sand, pozzolan, diatomaceous earth, iron pyrite, alumina, and calcium sulfate. In some cases, the cement may include polymer, resin, or latex, either as an additive or as the major constituent of the cement. The polymer may include polystyrene, ethylene/vinyl acetate copolymer, polymethylmethacrylate polyurethanes, polylactic acid, polyglycolic acid, polyvinylalcohol, polyvinylacetate, hydrolyzed ethylene/vinyl acetate, silicones, and combinations thereof. The cement may also include reinforcing fillers such as fiberglass, ceramic fiber, or polymer fiber. The cement may also include additives for improving or changing the properties of the cement, such as set accelerators, set retarders, defoamers, foaming agents, fluid loss agents, weighting materials, dispersants, density-reducing agents, formation conditioning agents, loss circulation materials, thixotropic agents, suspension aids, or combinations thereof.

The cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the cement compositions into motion, any valves or related joints used to regulate the pressure or flow rate of the cement compositions, and any sensors (i.e., pressure and temperature), gauges, and/or combinations thereof, and the like. The disclosed cement compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber-optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

In some examples, one or more tethered cement plugs may be deployed during a cementing operation. Tethered cement plugs can provide a communications interface (e.g., fiber optics) that can be used to obtain measurements during cementing and while waiting on cementitious slurry to develop compressive strength. Such measurements can include the position of the cement plug, temperature measurements, and pressure measurements, among others.

However, the communication line that is tethered to the cement plug can be damaged by the fluids (e.g., cement, mud, etc.) that are being pumped through the plug container. That is, the pump rates required to conduct a cementing operation (e.g., 3 to 8 barrels per minute) can cause an erosive and turbulent fluid flow that risks the integrity of the communication line that is tethered to the cement plug.

The disclosed technology addresses the foregoing by providing methods and systems for deploying a tethered cement plug using a cement head flow diverter. For instance, in some examples, a cement head can be configured to include a flow diversion apparatus that can enclose and protect the tethered cement plug prior to deployment (e.g., while the cement plug is still within the cement head). In some aspects, the flow diversion apparatus can include one or more protrusions (e.g., spiral vanes) that can be configured to divert fluid around the diversion apparatus and towards the internal casing wall to protect and prevent damage to the suspended cable as the cement plug is launched or displaced downhole. In some configurations, the flow diversion apparatus can also provide required fluid flow into designated areas of the cement plug to help propel and fill potential existing air voids as the cement plug leaves the originally installed position in the cement head.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 illustrates a system 2 that may be used in the preparation of a cement composition in accordance with the present disclosure. In particular, FIG. 1 illustrates a system 2 that can be used for the preparation of a cement composition and delivery of the composition to a wellbore in accordance with the present technology. As illustrated, the cement composition may be mixed in mixing equipment 4, such as a jet mixer, re-circulating mixer, or a batch mixer. The cement composition can then be pumped via pumping equipment 6 to the wellbore. In some instances, the mixing equipment 4 and the pumping equipment 6 may be disposed on one or more cement trucks as will be apparent to those of ordinary skill in the art. In some examples, a jet mixer may be used, for example, to continuously mix the composition, including water, as it is being pumped into the wellbore.

An example technique and system for placing a cement composition into a wellbore drilled through a subterranean earth formation will now be described with reference to FIG. 2A and FIG. 2B.

Figure 2A:
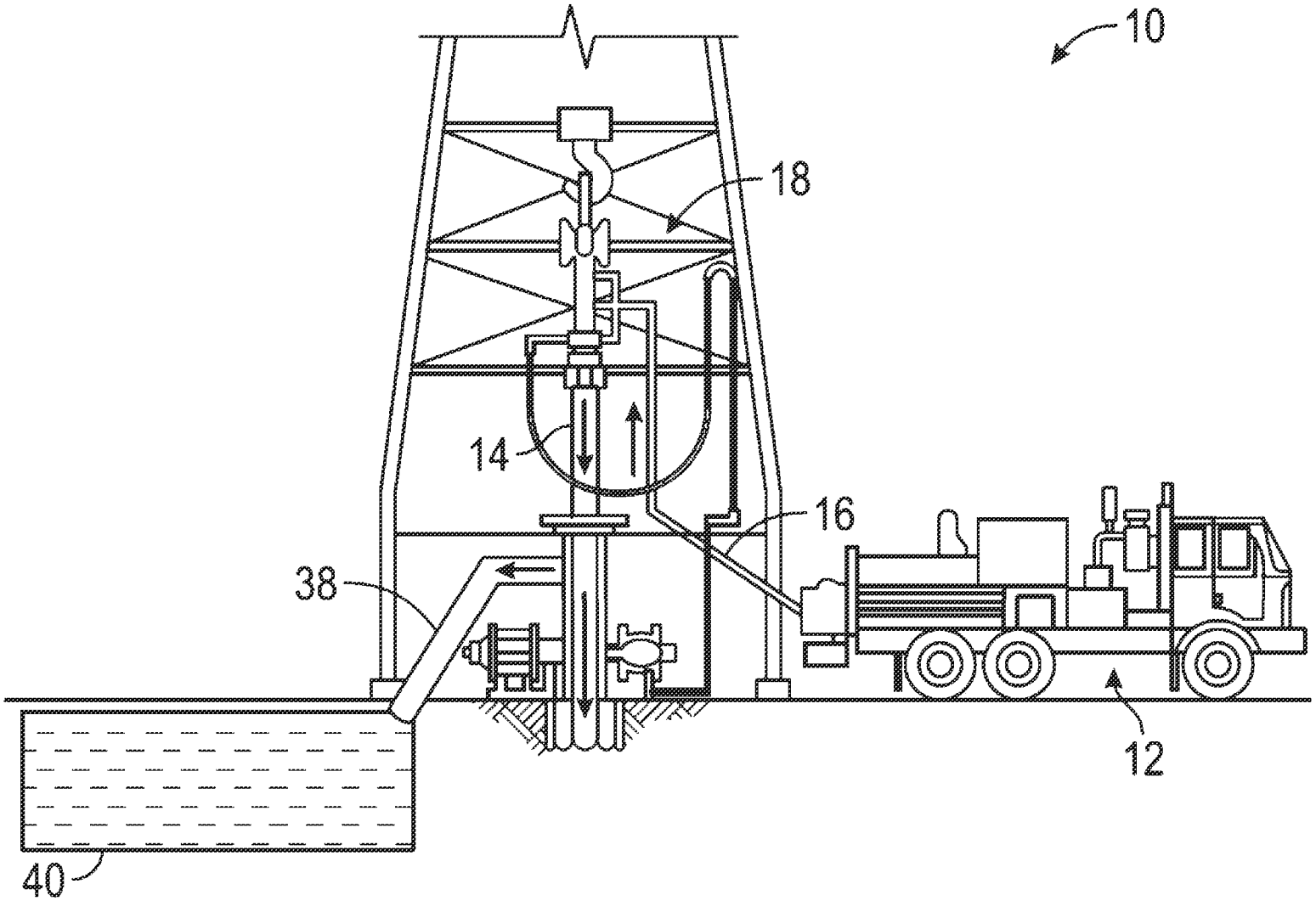
FIG. 2A illustrates surface equipment that may be used in placement of a cement composition in a wellbore, in accordance with aspects of the present disclosure.

FIG. 2A illustrates surface equipment 10 that may be used in the placement of a cement composition in accordance with certain aspects of the present disclosure. As illustrated, the surface equipment 10 may include a cementing unit 12, which may include one or more cement trucks. In some cases, the cementing unit 12 may include mixing equipment 4 and pumping equipment 6 (e.g., as described in connection with FIG. 1). The cementing unit 12 may pump a cement composition 14 through a feed pipe 16 and to a plug container 18 which conveys the cement composition 14 downhole. In some examples, the plug container 18 can be modified as described in further detail below to include a cement flow diversion apparatus. In some aspects, the plug container 18 can also be modified to permit deployment of a tethered cement plug (e.g., tethered to a communications line such as a fiber optic cable). The tethered cement plug can be used to capture one or more downhole data such as the position of the cement plug and/or temperature data, pressure data, etc.

Modifications, additions, or omissions may be made to FIG. 2A without departing from the scope of the present disclosure. For example, FIG. 2A depicts components of the operational well system 10 in a particular configuration. However, any suitable configuration of components may be used. Furthermore, fewer components or additional components beyond those illustrated may be included in the operational well system 10 without departing from the scope of the present disclosure. It should also be noted that while FIG. 2A generally depicts a land-based operation, those skilled in the art would recognize that the principles described herein are equally applicable to operations that employ floating or sea-based platforms and rigs, without departing from the scope of the present disclosure.

Figure 2B:
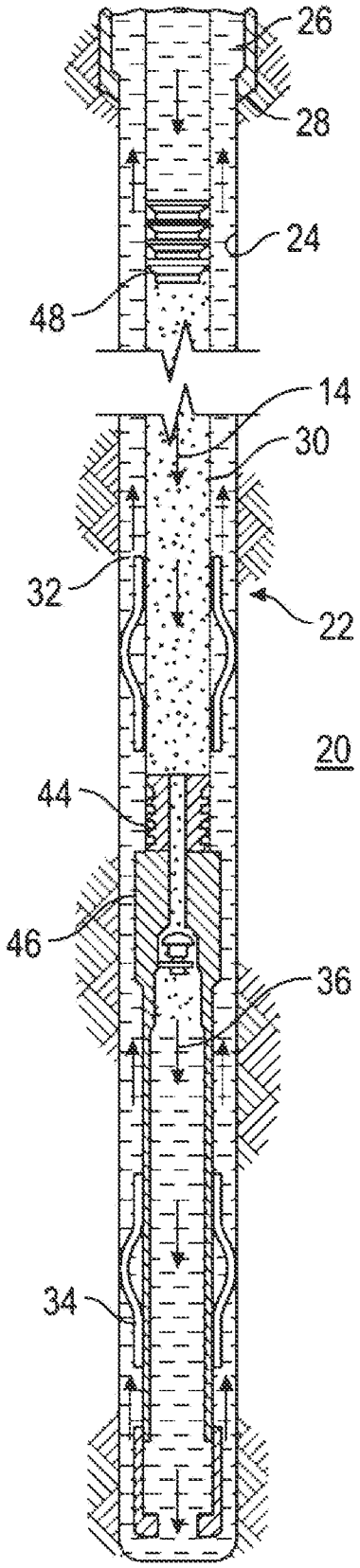
FIG. 2B illustrates placement of a cement composition into a wellbore annulus, in accordance with aspects of the present disclosure.

Turning now to FIG. 2B, the cementing composition 14 may be placed into a subterranean earth formation 20 in accordance with example aspects. As illustrated, a wellbore 22 may be drilled into the subterranean earth formation 20. The wellbore 22 comprises walls 24 and can have a surface casing 26 inserted into the wellbore 22. The surface casing 26 may be cemented to the walls 24 of the wellbore 22 by cement sheath 28. In some aspects, one or more additional conduits such as casing 30 (e.g., intermediate casing, production casing, liners, etc.) may also be disposed in the wellbore 22. As illustrated, a wellbore annulus 32 is formed between the casing 30 and the walls 24 of the wellbore 22 and/or the surface casing 26. One or more centralizers 34 may be attached to the casing 30, for example, to centralize the casing 30 in the wellbore 22 prior to and/or during the cementing operation.

With continued reference to FIG. 2B, the cement composition 14 may be pumped down the interior of the casing 30. In some instances, the cement composition 14 can include one or more binders. In some aspects, the cement composition 14 may be allowed to flow down the interior of the casing 30 into the wellbore annulus 32. The cement composition 14 may be allowed to set in the wellbore annulus 32, for example, to form a cement sheath that supports and positions the casing 30 in the wellbore 22. While not illustrated, other techniques may also be utilized for introduction of the cement composition 14.

In some aspects, as the cement composition 14 is introduced, the cement composition 14 may displace other fluids 36, such as drilling fluids and/or spacer fluids, which may be present in the interior of the casing 30 and/or the wellbore annulus 32. At least a portion of the displaced fluids 36 may exit the wellbore annulus 32 via a flow line 38 and be deposited, for example, in one or more retention pits 40 (e.g., a mud pit), as shown in FIG. 2A. Referring again to FIG. 2B, a bottom plug 44 may be introduced into the wellbore 22 ahead of the cement composition 14. For example, a bottom plug 44 can be used to separate the cement composition 14 from the fluids 36 that may be inside the casing 30 prior to cementing. After the bottom plug 44 reaches the landing collar 46, a diaphragm or other suitable device may be configured to rupture to allow the cement composition 14 through the bottom plug 44. In FIG. 2B, the bottom plug 44 is shown on the landing collar 46. In some cases, a top plug 48 may be introduced into the wellbore 22 behind the cement composition 14. The top plug 48 may separate the cement composition 14 from a displacement fluid 50 and also push the cement composition 14 through the bottom plug 44. As noted above, bottom plug 44 and/or top plug 48 may be deployed using a tethered connection that can be used to obtain real-time information from the wellbore, which can be used to improve the cementing process.

Modifications, additions, or omissions may be made to FIG. 2B without departing from the scope of the present disclosure. It should also be noted that while FIG. 2B generally depicts a vertical well section, those skilled in the art would readily recognize that the principles described herein are equally applicable to operations in inclined well sections, directional well sections, horizontal well sections, and the like without departing from the scope of the present disclosure.

Figure 3A:
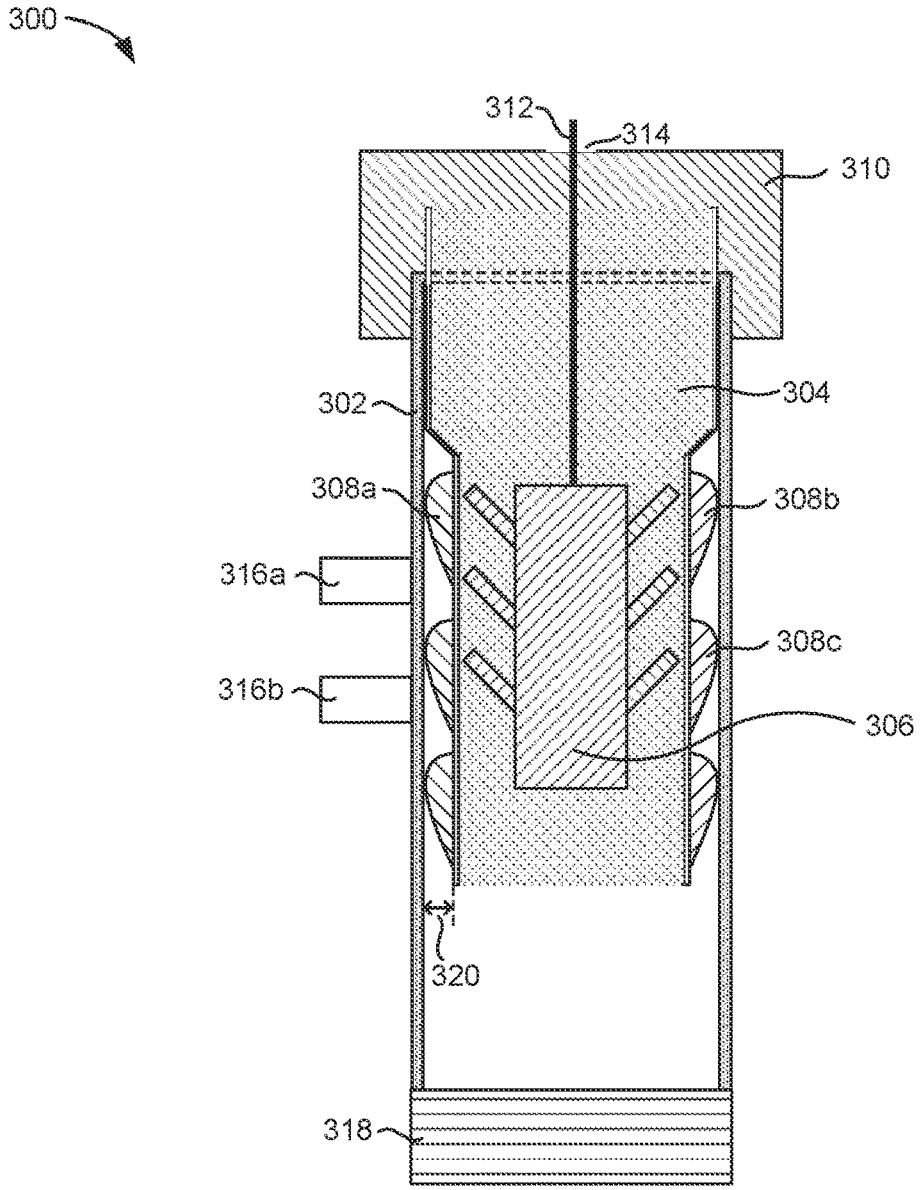
FIG. 3A illustrates a cross-sectional view of an exemplary plug container having a cement flow diversion apparatus and a tethered cement plug prior to deployment, in accordance with aspects of the present disclosure.

FIG. 3A illustrates a cross-sectional view of a plug container 300 having a cement flow diversion apparatus and a tethered cement plug, in accordance with aspects of the present disclosure. In some cases, the plug container 300 may be used with the cementing systems illustrated in FIG. 2A and FIG. 2B (e.g., plug container 300 may correspond to plug container 18).

In some examples, plug container 300 can be used to hold one or more cement plugs such as cement plug 306. In some cases, cement plug 306 may correspond to a top cement plug or a bottom cement plug. In some configurations, plug container 300 may also include one or more mechanisms such as pins, latches, clasps, etc. (not illustrated) that can be used to keep cement plug 306 within plug container 300. For example, plug container 300 may include pins that can support cement plug 306 and that can be removed to release cement plug 306 into the wellbore.

In some configurations, cement plug 306 can be tethered (e.g., coupled) to a communication line 312. In some cases, communication line 312 can correspond to any type of interface that can be used to send/receive data (e.g., using electronic or optical signals). In one illustrative example, communication line 312 can correspond to a fiber optic cable (e.g., the optical fibers may be single mode fibers, multi-mode fibers, or a combination thereof).

In some examples, communication line 312 can be spooled and placed into the body of cement plug 306. In some cases, communication line 312 may be affixed to plug container 300. As illustrated, communication line 312 passes through an aperture 314 on cap 310. Thus, in some cases, communication line 312 may be spooled outside of plug container 300.

In some aspects, communication line 312 can be coupled to one or more optical or electrical sensors/devices (not illustrated). For instance, fiber optic sensing systems connected to communication line 312 may include Distributed Temperature Sensing (DTS) systems, Distributed Acoustic Sensing (DAS) systems, Distributed Strain Sensing (DSS) systems, quasi-distributed sensing systems where multiple single point sensors are distributed along an optical fiber/cable, or single point sensing systems where sensors are located at the end of the communication line 312. Various hybrid approaches were single point, quasi-distributed, or distributed fiber optic sensors are mixed with e.g., electrical sensors, are also anticipated. The communication line 312 may then include optical fiber and electrical conductors.

In some examples, communication line 312 can be used to receive data from cement plug 306 during and/or after deployment downhole. For instance, communication line 312 can be used to track the position of cement plug 306 while it descends into the wellbore. In another example, communication line 312 can be used to obtain downhole measurements from cement plug 306 (e.g., via associated sensors) such as temperature measurements and/or pressure measurements. For instance, temperature measurements may be used to determine locations for fluid inflow in the treatment well as the fluids from the surface are likely to be cooler than formation temperatures.

In some aspects, plug container 300 can have a housing 302 (e.g., enclosure, container, frame, cylinder, etc.) that can have a top end that is coupled to a cap 310. As noted above, in some configurations, the cap 310 can include an aperture 314 that facilitates pass-through of communication line 312. For example, communication line 312 may be connected to computing equipment at a control or processing facility (not shown) at the surface of the wellbore. In some instances, cap 310 can be configured to isolate the pressure experienced on the downhole portion of the communication line 312. In some configurations, cap 310 can include a latch or mechanism (not illustrated) that can be used to attach communication line 312. In some cases, the bottom portion of housing 302 can include a casing thread 318 that can be used to couple the plug container 300 to a casing (e.g., casing thread 318 can be used to couple to surface casing 26).

In some instances, plug container 300 can include one or more inlet ports (e.g., valves) that can be used to attach cementing lines to the plug container 300. For example, plug container 300 can include inlet port 316*a* and inlet port 316*b* that can be used to pump fluids (e.g., cement) into the plug container 300 and down into the wellbore. In some aspects, the fluid (e.g., cement) can be pumped into plug container 300 and flow down the casing before cement plug 306 is deployed or released.

In some examples, plug container 300 can include a cement flow diversion apparatus such as inner canister 304. In some aspects, cement plug 306 can be positioned within inner canister 304 prior to being deployed such that cement plug 306 and communication line 312 are protected from the influx of fluids that are pumped in via inlet port 316*a* and/or inlet port 316*b*. That is, inner canister 304 can be used to house and centralize cement plug 306 prior to launching. Further, inner canister 304 can provide access for fluid displacement and protect the suspended cable (e.g., communication line 312) and cement plug 306 from fluid impingement.

In some aspects, the top portion of inner canister 304 can have an outside diameter that is approximately equal to the inside diameter of housing 302. That is, the top portion of inner canister 304 can abut or be flush to housing 302. Such a configuration can keep fluid from flowing above cement plug 306 during displacement operations. In some cases, a portion of inner canister 304 can extend beyond a top opening of housing 302. In some instances, cap 310 can be configured to encapsulate the top portion of inner canister 304 as well as the housing 302 of plug container 300.

In some examples, a bottom portion of inner canister 304 can have an outside diameter that is less than the inside diameter of housing 302. That is, inner canister 304 can be configured such that an angular gap or annulus (e.g., annulus 320) is formed between the bottom portion of inner canister 304 and the inside of housing 302. In some cases, the bottom portion of inner canister 304 can have one or more protrusions (e.g., spiral vanes, threads, flutes, etc.) such as protrusion 308*a*, protrusion 308*b*, and protrusion 308*c* (collectively referred to as "protrusions 308") that are arranged along the outside or perimeter of inner canister 304. The protrusions 308 can extend into the annulus 320 and direct the fluid flow from inlet port 316*a* and/or inlet port 316*b* down through annulus 320 and towards the internal casing wall.

Figure 3B:
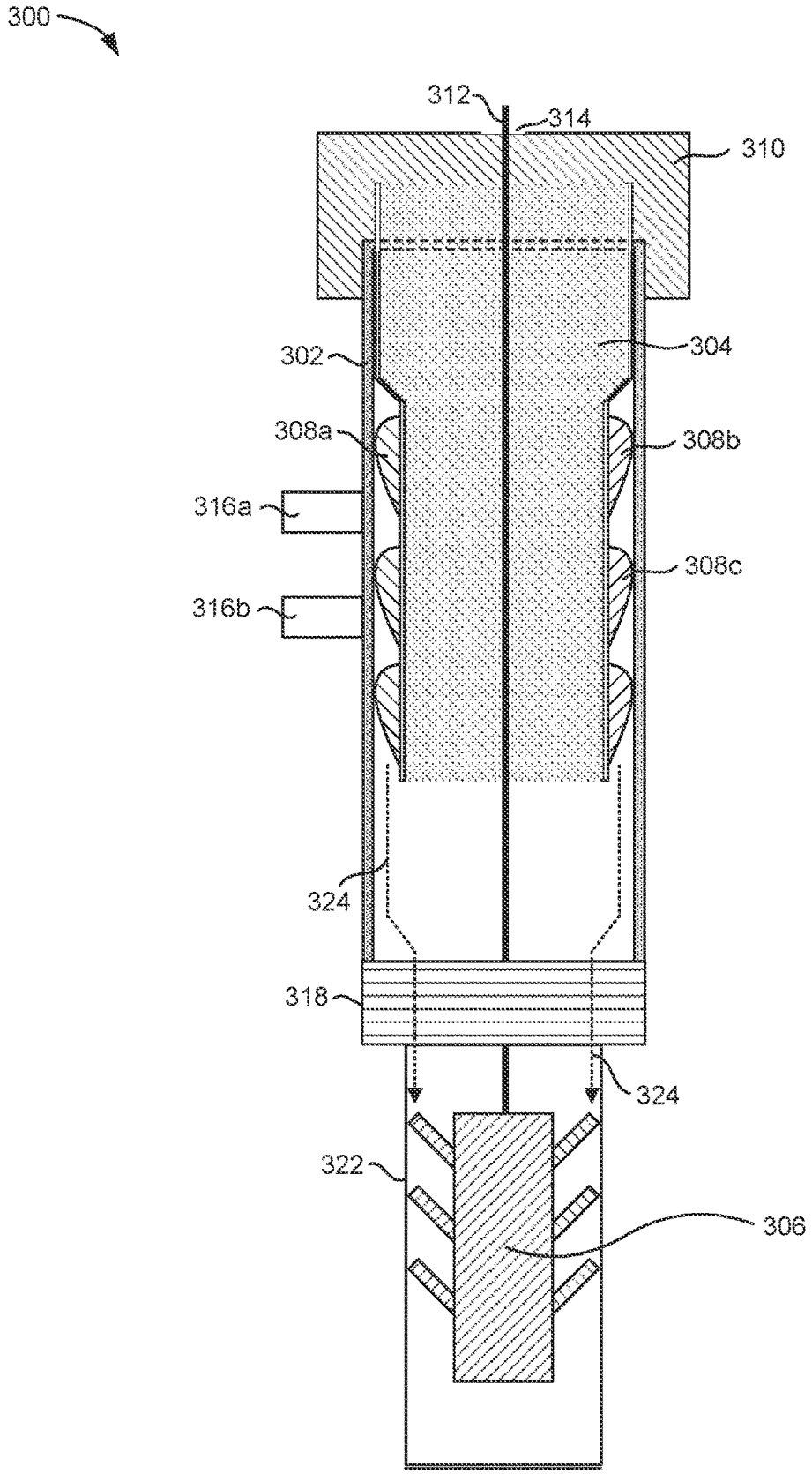
FIG. 3B illustrates a cross-sectional view of an exemplary plug container having a cement flow diversion apparatus and a tethered cement plug after deployment, in accordance with aspects of the present disclosure.

FIG. 3B illustrates another cross-sectional view of a plug container 300 having a cement flow diversion apparatus and a tethered cement plug in a second position. As illustrated in FIG. 3B, cement plug 306 has been deployed into the wellbore and is positioned inside casing 322. While the cement plug 306 descends into the wellbore, a communication line 312 (e.g., fiber) can be deployed into a wellbore via cement plug 306 by unspooling a communication line 312. In some cases, the communication line 312 can be stored within the body of the cement plug 306, within plug container 300, or outside of plug container 300. In some instances, the other end of the communication line 312 can be affixed to the plug container 300, whereby the communication line 312 is fed through a modified plug container cap 310 capable of isolating the pressure experienced on the downhole portion of the fiber.

In further examples, the communication line 312 can be connected to a device that allows the data to be sent through the cap 310 in the plug container 300 to a control or processing system, such as data acquisition system, located on the surface. In at least some instances, the communication line 312 can be used for the purpose of tracking the location of the cement plug 306 and evaluating the effectiveness of the cementing process. However, as the communication line 312 is deployed it can be subjected to forces from fluids within the wellbore in the axial direction.

As noted with respect to FIG. 3A, inner canister 304 can include protrusions 308 that can be used to direct the flow of fluids within plug container 300 and down into the wellbore. That is, the protrusions 308 on inner canister 304 can direct fluid that is pumped to inlet port 316*a* and/or inlet port 316*b* to flow circumferentially around inner canister 304. As the fluid descends into the wellbore, the centrifugal force generated by way of protrusions 308 can cause the fluid to flow along the internal diameter of casing 322 (e.g., as illustrated by flow path 324). This preferential flow path 324 can divert cement, mud, and/or well fluids away from communication line 312 and towards the internal casing wall. That is, although flow path 324 is illustrated using straight lines, flow path 324 is generally circumferential along the inner diameter of housing 302 and casing 322. Consequently, communication line 312 is protected from flow erosion damage (e.g., the turbulence of the flow is reduced around the deployed communication line 312 in the central portion of casing 322).

Figure 4:
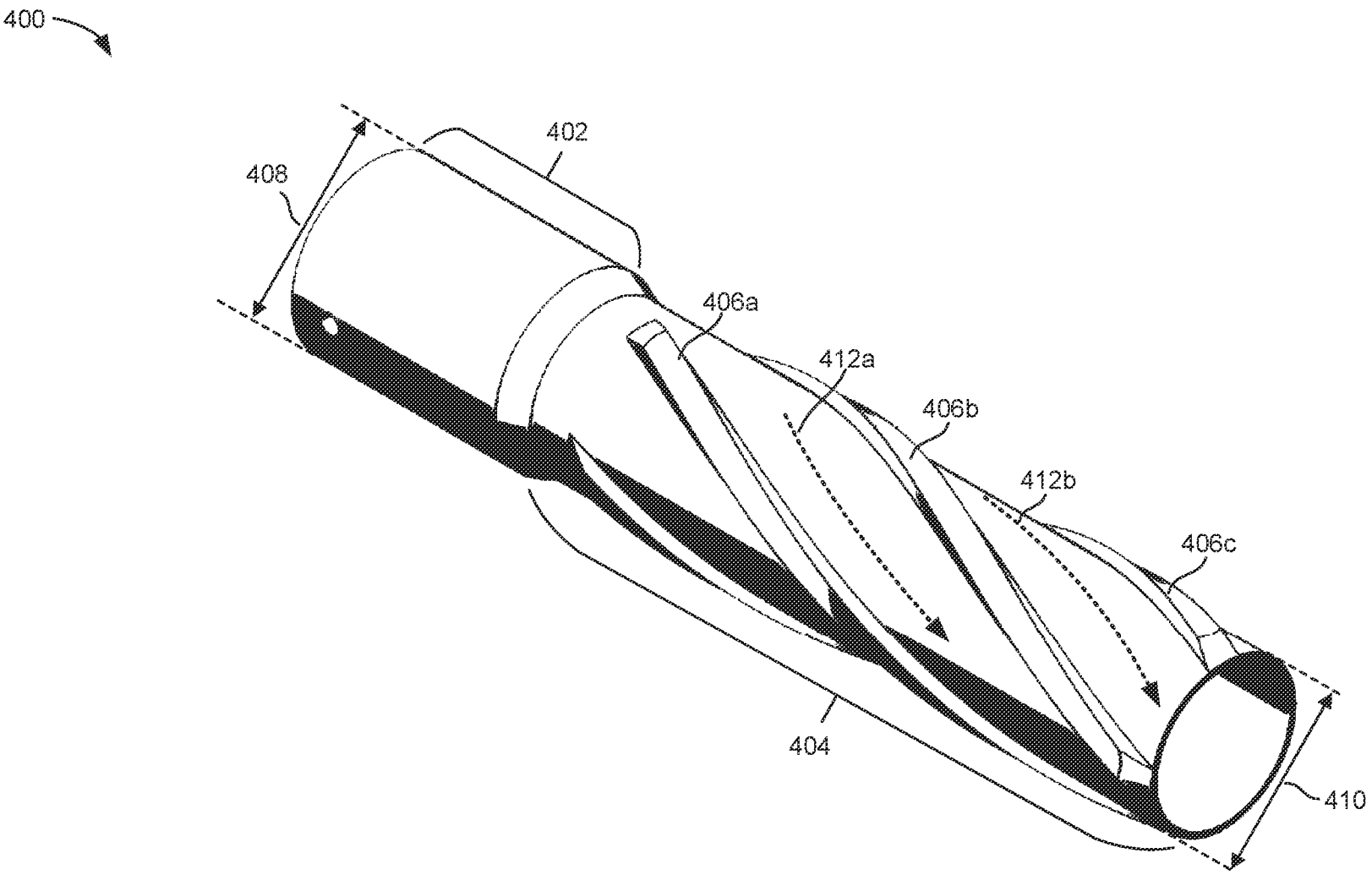
FIG. 4 illustrates an exemplary cement flow diversion apparatus, in accordance with aspects of the present disclosure.

FIG. 4 illustrates an exemplary cement flow diversion apparatus 400. In some examples, the flow diversion apparatus 400 can be used to divert fluid flow within a cement head or a plug container. In some cases, flow diversion apparatus 400 can correspond to inner canister 304. That is, the flow diversion apparatus 400 can have an interior space that accommodates and shields a cement plug prior to deployment.

In some examples, flow diversion apparatus 400 can include a top portion 402 having an outside diameter 408. In some cases, the outside diameter 408 of the top portion 402 can be approximately the same as the inside diameter of a plug container such that the top portion 402 of the flow diversion apparatus 400 abuts the inside of the plug container.

In some cases, flow diversion apparatus 400 can include a bottom portion 404 having an outside diameter 410. In some examples, the outside diameter 410 of the bottom portion 404 can be less than the inside diameter of a plug container such that an annulus is formed between the outside diameter 410 of the bottom portion 404 and the inside of the plug container.

In some aspects, the bottom portion 404 of the flow diversion apparatus 400 can include one or more protrusions such as protrusion 406*a*, protrusion 406*b*, and/or protrusion 406*c* (collectively referred to as "protrusions 406"). In some configurations, protrusions 406 can include spiral vanes, threads, and/or any other suitable structure that can be used to divert fluid flow in a downward direction (e.g., away from top portion 402 of flow diversion apparatus 400). In some instances, protrusions 406 can cause fluids that are pumped into a plug container or cement head to flow along the annulus between bottom portion 404 and the inside diameter of the plug container or the cement head. For example, protrusion 406*a* and protrusion 406*b* may cause a flow 412*a* that is downward and circumferential (e.g., within an annulus between bottom portion 404 and the inside of a plug container). In another example, protrusion 406*b* and protrusion 406*c* may cause a flow 412*b* that is also downward and circumferential. Further, in some aspects, the protrusions 406 can be used to generate a force that causes the liquid to flow downward into along or proximate to the casing wall. In some aspects, such a fluid flow can be used to protect the connection to a tethered cement plug, which permits collection of data during a cementing operation.

Figure 5:
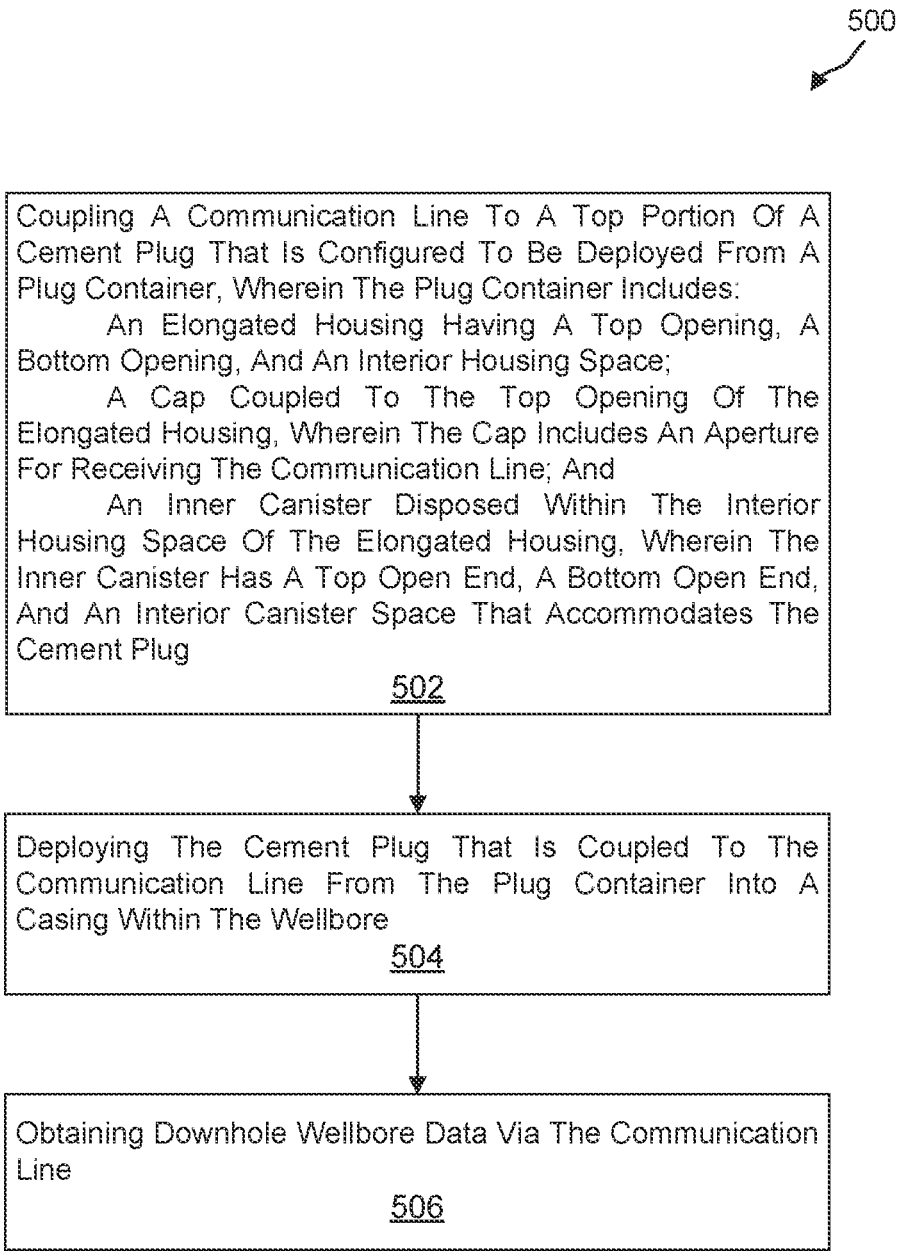
FIG. 5 is a flowchart diagram of a process of evaluating a wellbore using a tethered cement plug, in accordance with aspects of the present disclosure.

FIG. 5 illustrates an example of a process 500 for evaluating a wellbore (e.g., during a cementing operation). It is to be appreciated that not all steps may be needed to perform the disclosure provided herein. Further, some of the steps may be performed simultaneously, or in a different order than shown in FIG. 5, as will be understood by a person of ordinary skill in the art.

At block 502, the process 500 includes coupling a communication line to a top portion of a cement plug that is configured to be deployed from a plug container, wherein the plug container includes: an elongated housing having a top opening, a bottom opening, and an interior housing space; a cap coupled to the top opening of the elongated housing, wherein the cap includes an aperture for receiving the communication line; and an inner canister disposed within the interior housing space of the elongated housing, wherein the inner canister has a top open end, a bottom open end, and an interior canister space that accommodates the cement plug.

For example, communication line 312 can be connected to a top portion of cement plug 306 that is configured to be deployed from plug container 300. In some aspects, plug container 300 can include an elongated housing (e.g., housing 302) having a top opening, a bottom opening, and an interior housing space. In some cases, plug container 300 can include a cap 310 that is coupled to the top opening of housing 302, wherein cap 310 includes aperture 314 for receiving communication line 312. In some aspects, plug container 300 can include inner canister 304 disposed within the interior housing space of housing 302, wherein inner canister 304 has a top open end, a bottom open end, and an interior canister space that accommodates cement plug 306.

In some aspects, the inner canister can include one or more protrusions that are disposed on an exterior surface of the inner canister. For example, inner canister 304 can include protrusions 308 that are disposed (e.g., arranged, formed, etc.) on an exterior surface of inner canister 304. In some instances, the one or more protrusions can include one or more spiral vanes.

In some configurations, a perimeter of the top open end of the inner canister can abut the interior housing space of the elongated housing. For example, top portion 402 of flow diversion apparatus 400 can be configured to abut the interior housing space of housing 302.

In some cases, the bottom open end of the inner canister can have an outside diameter that is less than an inside diameter of the interior housing space of the elongated housing thereby forming an annulus between the inner canister and the elongated housing. For instance, diameter 410 of the bottom portion 404 of flow diversion apparatus 400 can be less than an inside diameter of housing 302, thereby forming annulus 320.

At block 504, the process 500 includes deploying the cement plug that is coupled to the communication line from the plug container into a casing within the wellbore. For example, cement plug 306 that is coupled to communication line 312 can be deployed from plug container 300 into casing 322.

At block 506, the process 500 includes obtaining downhole wellbore data via the communication line. For example, a computing device that is coupled to communication line 312 (e.g., on the surface) can be used to obtain downhole wellbore data and monitor a cementing operation. In some cases, the downhole wellbore data can include at least one of a temperature measurement, a pressure measurement, and a location of the cement plug. In some examples, the process 500 can include adjusting one or more parameters associated with a cementing operation based on the downhole wellbore data.

In some aspects, the process 500 can include pumping a cement composition into an at least one inlet flow port of the plug container, wherein the one or more protrusions cause the cement composition to flow to the bottom opening of the elongated housing via an annulus between the inner canister and the elongated housing. For example, a cement composition can be pumped via inlet port 316*a* and/or inlet port 316*b* and protrusions 308 can cause the cement composition to flow via annulus 320 (e.g., along flow path 324).

Figure 6:
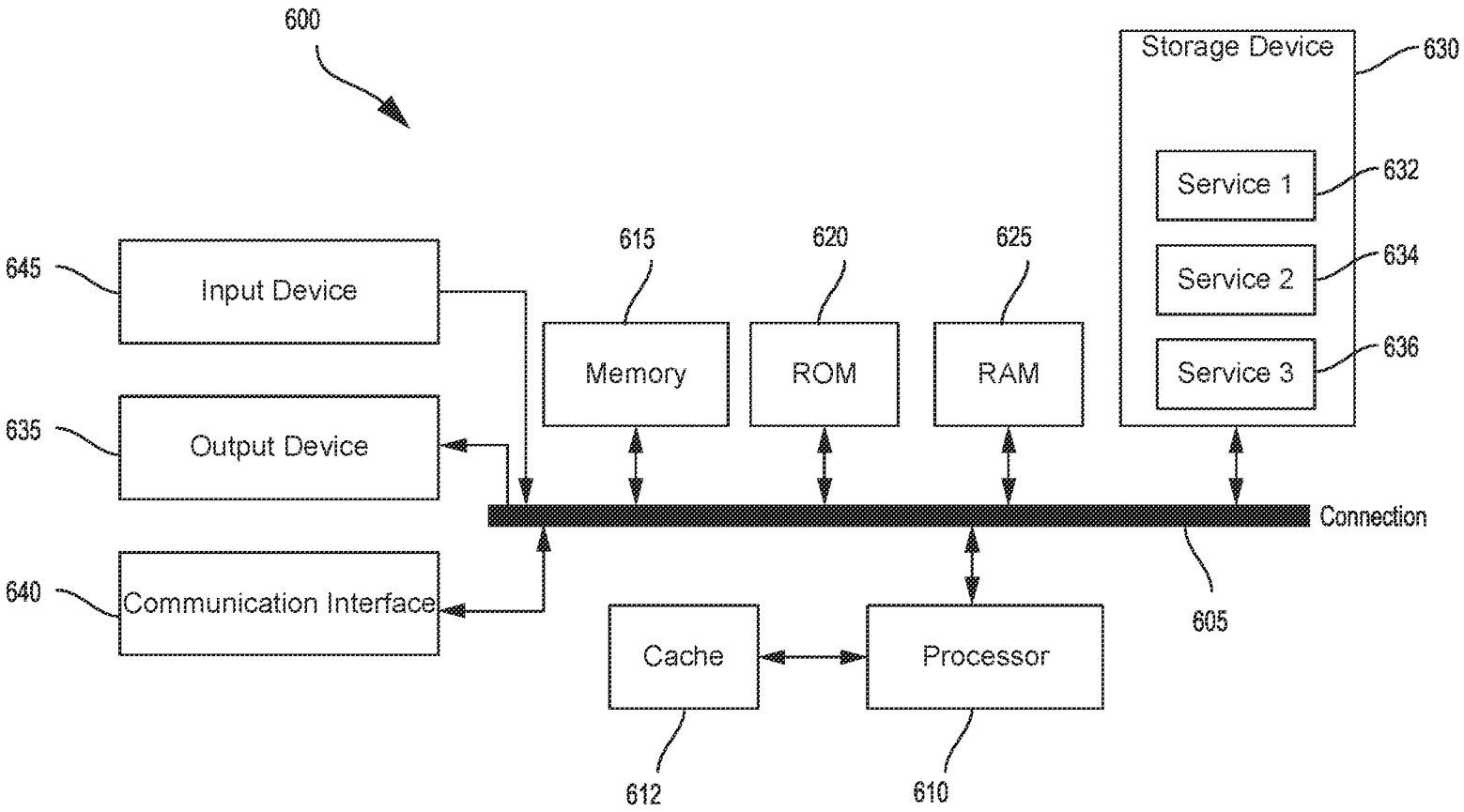
FIG. 6 is a block diagram illustrating an example computing device architecture, in accordance with aspects of the present disclosure.

FIG. 6 illustrates an example computing device architecture 600 which can be employed to perform various steps, methods, and techniques disclosed herein. Specifically, the techniques described herein can be implemented, at least in part, through the computing device architecture 600 in a surface controller during a cementing operation. The various implementations will be apparent to those of ordinary skill in the art when practicing the present technology. Persons of ordinary skill in the art will also readily appreciate that other system implementations or examples are possible.

As noted above, FIG. 6 illustrates an example computing device architecture 600 of a computing device which can implement the various technologies and techniques described herein. The components of the computing device architecture 600 are shown in electrical communication with each other using a connection 605, such as a bus. The example computing device architecture 600 includes a processing unit (CPU or processor) 610 and a computing device connection 605 that couples various computing device components including the computing device memory 615, such as read only memory (ROM) 620 and random access memory (RAM) 625, to the processor 610.

The computing device architecture 600 can include a cache of high-speed memory connected directly with, in close proximity to, or integrated as part of the processor 610. The computing device architecture 600 can copy data from the memory 615 and/or the storage device 630 to the cache 612 for quick access by the processor 610. In this way, the cache can provide a performance boost that avoids processor 610 delays while waiting for data. These and other modules can control or be configured to control the processor 610 to perform various actions. Other computing device memory 615 may be available for use as well. The memory 615 can include multiple different types of memory with different performance characteristics. The processor 610 can include any general purpose processor and a hardware or software service, such as service 1 632, service 2 634, and service 3 636 stored in storage device 630, configured to control the processor 610 as well as a special-purpose processor where software instructions are incorporated into the processor design. The processor 610 may be a self-contained system, containing multiple cores or processors, a bus, memory controller, cache, etc. A multi-core processor may be symmetric or asymmetric.

To enable user interaction with the computing device architecture 600, an input device 645 can represent any number of input mechanisms, such as a microphone for speech, a touch-sensitive screen for gesture or graphical input, keyboard, mouse, motion input, speech and so forth. An output device 635 can also be one or more of a number of output mechanisms known to those of skill in the art, such as a display, projector, television, speaker device, etc. In some instances, multimodal computing devices can enable a user to provide multiple types of input to communicate with the computing device architecture 600. The communications interface 640 can generally govern and manage the user input and computing device output. There is no restriction on operating on any particular hardware arrangement and therefore the basic features here may easily be substituted for improved hardware or firmware arrangements as they are developed.

Storage device 630 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 625, read only memory (ROM) 620, and hybrids thereof. The storage device 630 can include services 632, 634, 636 for controlling the processor 610. Other hardware or software modules are contemplated. The storage device 630 can be connected to the computing device connection 605. In one aspect, a hardware module that performs a particular function can include the software component stored in a computer-readable medium in connection with the necessary hardware components, such as the processor 610, connection 605, output device 635, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A cement head comprising: an elongated housing having a top opening, a bottom opening, and an interior housing space; a cap coupled to the top opening of the elongated housing, wherein the cap includes an aperture for receiving a communication line; an inner canister disposed within the interior housing space of the elongated housing, wherein the inner canister has a top open end, a bottom open end, and an interior canister space; and a cement plug disposed within the interior canister space of the inner canister, wherein a top portion of the cement plug is configured to couple to the communication line through the top open end of the inner canister, and wherein the cement plug is configured to be deployed into a wellbore through the bottom open end of the inner canister.

Statement 2: The cement head of Statement 1, wherein the inner canister further comprises one or more protrusions that are disposed on an exterior surface of the inner canister.

Statement 3: The cement head of Statement 2, wherein the one or more protrusions comprise one or more spiral vanes.

Statement 4: The cement head of any of Statements 1 to 3, wherein the elongated housing further comprises at least one inlet flow port, wherein the inner canister is configured to shield the cement plug from a cement composition flowing through the at least one inlet flow port.

Statement 5: The cement head of Statement 4, wherein the inner canister is configured to direct the cement composition flowing through the at least one inlet flow port to the bottom opening of the elongated housing via an annulus between the inner canister and the elongated housing.

Statement 6: The cement head of any of Statements 1 to 5, wherein a perimeter of the top open end of the inner canister abuts the interior housing space of the elongated housing.

Statement 7: The cement head of any of Statements 1 to 6, wherein the bottom open end of the inner canister has an outside diameter that is less than an inside diameter of the interior housing space of the elongated housing thereby forming an annulus between the inner canister and the elongated housing.

Statement 8: The cement head of any of Statements 1 to 7, further comprising: a threaded connector at the bottom opening of the elongated housing, wherein the threaded connector couples the cement head to a casing in the wellbore.

Statement 9: A method for evaluating a wellbore, comprising: coupling a communication line to a top portion of a cement plug that is configured to be deployed from a plug container, wherein the plug container includes: an elongated housing having a top opening, a bottom opening, and an interior housing space; a cap coupled to the top opening of the elongated housing, wherein the cap includes an aperture for receiving the communication line; and an inner canister disposed within the interior housing space of the elongated housing, wherein the inner canister has a top open end, a bottom open end, and an interior canister space that accommodates the cement plug; deploying the cement plug that is coupled to the communication line from the plug container into a casing within the wellbore; and obtaining downhole wellbore data via the communication line.

Statement 10: The method of Statement 9, wherein the inner canister includes one or more protrusions that are disposed on an exterior surface of the inner canister.

Statement 11: The method of Statement 10, further comprising: pumping a cement composition into an at least one inlet flow port of the plug container, wherein the one or more protrusions cause the cement composition to flow to the bottom opening of the elongated housing via an annulus between the inner canister and the elongated housing.

Statement 12: The method of any of Statements 10 to 11, wherein the one or more protrusions comprise one or more spiral vanes.

Statement 13: The method of any of Statements 9 to 12, wherein a perimeter of the top open end of the inner canister abuts the interior housing space of the elongated housing.

Statement 14: The method of any of Statements 9 to 13, wherein the bottom open end of the inner canister has an outside diameter that is less than an inside diameter of the interior housing space of the elongated housing thereby forming an annulus between the inner canister and the elongated housing.

Statement 15: The method of any of Statements 9 to 14, wherein the downhole wellbore data includes at least one of a temperature measurement, a pressure measurement, and a location of the cement plug.

Statement 16: The method of any of Statements 9 to 15, further comprising: adjusting one or more parameters associated with a cementing operation based on the downhole wellbore data.

Statement 17: An apparatus comprising at least one memory; and at least one processor coupled to the at least one memory, wherein the at least one processor is configured to perform operations in accordance with any one of Statements 9 to 16.

Statement 18: An apparatus comprising means for performing operations in accordance with any one of Statements 9 to 16.

Statement 19: A non-transitory computer-readable medium comprising instructions that, when executed by an apparatus, cause the apparatus to perform operations in accordance with any one of Statements 9 to 16.

Statement 20: A system comprising: a plug container: at least one cement plug containing a spool capable of deploying a communication line while the at least one cement plus is displaced downhole; and at least one controller coupled to the at least one cement plug via the communication line, wherein the plug container is configured to hold and deploy the at least one cement plug, and wherein the plug container includes: an elongated housing having a top opening, a bottom opening, and an interior housing space; a cap coupled to the top opening of the elongated housing, wherein the cap includes an aperture for receiving the communication line; and an inner canister disposed within the interior housing space of the elongated housing, wherein the inner canister has a top open end, a bottom open end, and an interior canister space that accommodates the at least one cement plug.

Statement 21: The system of Statement 20, wherein the inner canister includes one or more protrusions that are disposed on an exterior surface of the inner canister.

Statement 22: The system of any of Statements 20 to 21, wherein a perimeter of the top open end of the inner canister abuts the interior housing space of the elongated housing.

Statement 23: The system of any of Statements 20 to 22, wherein the bottom open end of the inner canister has an outside diameter that is less than an inside diameter of the interior housing space of the elongated housing thereby forming an annulus between the inner canister and the elongated housing.

What is claimed is:

1. A cement head comprising:

an elongated housing having a top opening, a bottom opening, and an interior housing space;

a cap coupled to the top opening of the elongated housing, wherein the cap includes an aperture for receiving a communication line;

an inner canister disposed within the interior housing space of the elongated housing, wherein the inner canister has a top open end, a bottom open end, and an interior canister space and wherein a perimeter of the top open end of the inner canister abuts the interior housing space of the elongated housing; and a cement plug disposed within the interior canister space of the inner canister, wherein a top portion of the cement plug is configured to couple to the communication line through the top open end of the inner canister, and wherein the cement plug is configured to be deployed into a wellbore through the bottom open end of the inner canister.

2. The cement head of claim 1, wherein the inner canister further comprises one or more protrusions that are disposed on an exterior surface of the inner canister.

3. The cement head of claim 2, wherein the one or more protrusions comprise one or more spiral vanes.

4. The cement head of claim 1, wherein the elongated housing further comprises at least one inlet flow port, wherein the inner canister is configured to shield the cement plug from a cement composition flowing through the at least one inlet flow port.

5. The cement head of claim 4, wherein the inner canister is configured to direct the cement composition flowing through the at least one inlet flow port to the bottom opening of the elongated housing via an annulus between the inner canister and the elongated housing.

6. The cement head of claim 1, wherein the bottom open end of the inner canister has an outside diameter that is less than an inside diameter of the interior housing space of the elongated housing thereby forming an annulus between the inner canister and the elongated housing.

7. The cement head of claim 1, further comprising:

a threaded connector at the bottom opening of the elongated housing, wherein the threaded connector couples the cement head to a casing in the wellbore.

8. A method for evaluating a wellbore, comprising:

coupling a communication line to a top portion of a cement plug that is configured to be deployed from a plug container, wherein the plug container includes:

an elongated housing having a top opening, a bottom opening, and an interior housing space;

a cap coupled to the top opening of the elongated housing, wherein the cap includes an aperture for receiving the communication line; and an inner canister disposed within the interior housing space of the elongated housing, wherein the inner canister has a top open end, a bottom open end, and an interior canister space that accommodates the cement plug and wherein a perimeter of the top open end of the inner canister abuts the interior housing space of the elongated housing;

deploying the cement plug that is coupled to the communication line from the plug container into a casing within the wellbore; and obtaining downhole wellbore data via the communication line.

9. The method of claim 8, wherein the inner canister includes one or more protrusions that are disposed on an exterior surface of the inner canister.

10. The method of claim 9, further comprising:

pumping a cement composition into an at least one inlet flow port of the plug container, wherein the one or more protrusions cause the cement composition to flow to the bottom opening of the elongated housing via an annulus between the inner canister and the elongated housing.

11. The method of claim 9, wherein the one or more protrusions comprise one or more spiral vanes.

12. The method of claim 8, wherein the bottom open end of the inner canister has an outside diameter that is less than an inside diameter of the interior housing space of the elongated housing thereby forming an annulus between the inner canister and the elongated housing.

13. The method of claim 8, wherein the downhole wellbore data includes at least one of a temperature measurement, a pressure measurement, and a location of the cement plug.

14. The method of claim 8, further comprising:

adjusting one or more parameters associated with a cementing operation based on the downhole wellbore data.

15. A system comprising:

a plug container;

at least one cement plug containing a spool capable of deploying a communication line while the at least one cement plug is displaced downhole; and at least one controller coupled to the at least one cement plug via the communication line, wherein the plug container is configured to hold and deploy the at least one cement plug, and wherein the plug container includes:

an elongated housing having a top opening, a bottom opening, and an interior housing space;

a cap coupled to the top opening of the elongated housing, wherein the cap includes an aperture for receiving the communication line; and an inner canister disposed within the interior housing space of the elongated housing, wherein the inner canister has a top open end, a bottom open end, and an interior canister space that accommodates the at least one cement plug and wherein a perimeter of the top open end of the inner canister abuts the interior housing space of the elongated housing.

16. The system of claim 15, wherein the inner canister includes one or more protrusions that are disposed on an exterior surface of the inner canister.

17. The system of claim 15, wherein the bottom open end of the inner canister has an outside diameter that is less than an inside diameter of the interior housing space of the elongated housing thereby forming an annulus between the inner canister and the elongated housing.

* * * * *